United States Patent [19]

Schleisner

[11] Patent Number: 4,677,805

[45] Date of Patent: Jul. 7, 1987

[54] STRUCTURAL CONNECTOR

[76] Inventor: Uriel Schleisner, 68-70 Bar- Kochba Street, Petach Tiqva, Israel

[21] Appl. No.: 775,491

[22] Filed: Sep. 12, 1985

[30] Foreign Application Priority Data

Nov. 1, 1984 [IL] Israel ..... 73390
Mar. 1, 1985 [IL] Israel ..... 74479

[51] Int. Cl.[4] ..... F16L 39/00

[52] U.S. Cl. ..... 52/648; 403/170; 403/391

[58] Field of Search ..... 52/648; 403/169, 170, 403/171, 176, 391, 396

[56] References Cited

U.S. PATENT DOCUMENTS

| | | | |
|---|---|---|---|
| 548,165 | 10/1895 | Lavender | 403/169 X |
| 2,879,087 | 3/1959 | Haglund | 403/169 |
| 3,360,883 | 1/1968 | Glanzer | 403/176 |
| 3,563,581 | 2/1971 | Sommerstein | 403/314 X |
| 3,966,337 | 6/1976 | Crawford | 403/170 |
| 4,171,838 | 10/1979 | Grundy | 403/391 X |
| 4,213,640 | 7/1980 | Miles | 403/391 X |
| 4,437,288 | 3/1984 | Foissac et al. | 52/648 |
| 4,470,238 | 9/1984 | Maistre | 52/648 |

FOREIGN PATENT DOCUMENTS

| | | | |
|---|---|---|---|
| 633641 | 8/1936 | Fed. Rep. of Germany | 403/391 |
| 2904330 | 8/1979 | Fed. Rep. of Germany | 52/648 |
| 1012892 | 4/1952 | France | 403/391 |
| 1064552 | 12/1953 | France | 403/396 |
| 346812 | 3/1937 | Italy | 403/396 |
| 530341 | 12/1940 | United Kingdom | 403/391 |

*Primary Examiner*—J. Karl Bell
*Attorney, Agent, or Firm*—Toren, McGeady & Associates

[57] ABSTRACT

A joint is provided by means of which structural elements, such as steel bars or pipes can be connected with one another to form spatial structures, say the skeletons of roof constructions. The joint consists of a hollow cylinder or prism in the wall or walls of which are apertures into which the said structural elements are inserted.

12 Claims, 23 Drawing Figures

STRUCTURAL CONNECTOR

This invention relates to joints for connecting structural elements. The new joint has been designed for use in spatial structures and is specially, but not exclusively, adapted for use in spatial roof construction.

It is the main object of the invention to provide a joint which permits quick and sure connection of the respective structural parts, the necessary operation being effected—wherever desired—in a workshop, thus permitting semi-finished structural parts to be carried to the respective building site for final assembly. Needless to say that all operations may also be conducted at that site, should this be preferable for whatever reasons, e.g. difficult terrain which would not allow transportation of bulky assembled structures.

The invention makes use of tubular elements but does not exclude the use of rods and bars.

According to the invention there is provided a joint consisting of a hollow prism or cylinder which at its sides normal to one another has openings which are at different levels and permit the passage of elongated structural elements, spigot like sleeves extending from the joint at an angle from at least one side of the joint.

According to one embodiment of the invention, the openings in the sides of the joints merge into slots at diametrically opposite sides of the joint.

According to a preferred embodiment of the invention, the joint is a four-sided prism.

According to yet another feature, the said spigot like sleeves are lengthwise slitted.

Experience in working with joints of this kind shows that with bar shaped elements whenever they are of excessive length it is advantageous to make the joint of two pieces instead of its being an integral one piece body.

Thus for such cases there is provided according to the invention a structural element connecting joint which at its sides has openings at different levels to permit the passage of elongated structural elements the said joint being constituted by a cylindrical or prismatic body composed of at least one lower first cylindrical or prismatic part and at least one upper, second cylindrical or prismatic part, spigot like sleeves extending from at least one of the said parts.

The invention further relates to a method of assembling a spatial structure from a number of the said joints and a number of elongated structural elements, i.e. bars of pipes.

The invention will be more fully understood from the following detailed description which has reference to the accompanying drawings in which appear schematically in:

FIG. 1 a perspective view of an embodiment of the new joint.

FIG. 2 being a plan view thereof.

FIG. 3 is a section on line A—A of FIG. 2, and

FIG. 4 a section on line B—B of FIG. 2.

FIGS. 5, 6 and 7—correspond to FIGS. 2–4 and are destined to serve as joints for rectangularly profiled tubular elements.

FIGS. 8 and 9, finally, illustrate joints adapted for a special purpose.

FIGS. 20 and 21 illustrate variants of a joint, while

Figure 1:
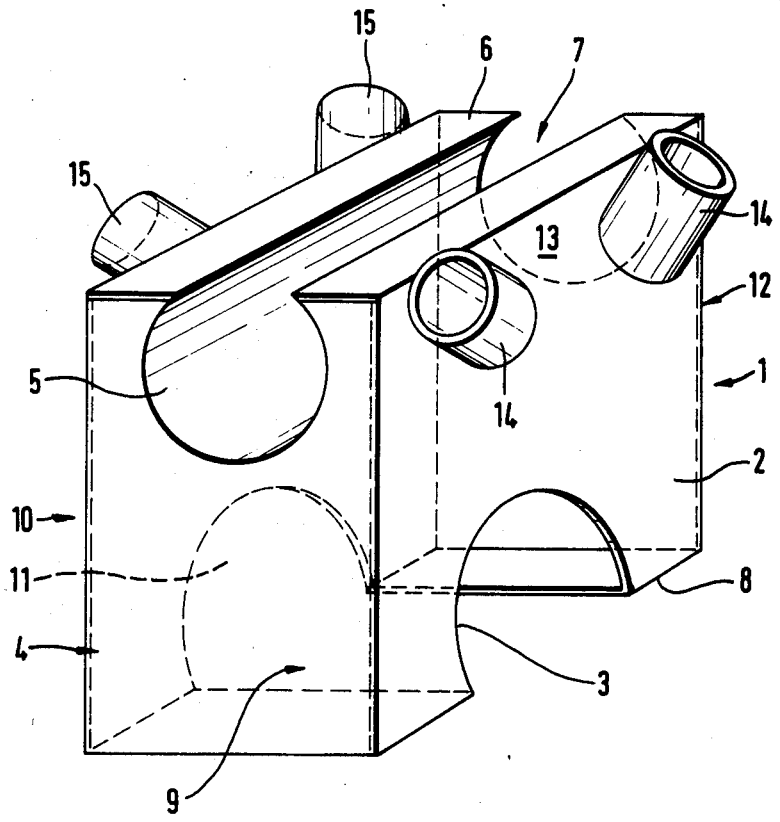

As seen in FIG. 1, the new joint is mainly constituted by a prismatic, hollow body designated as a whole by the numeral 1. In the side wall 2 of body 1 is provided an opening 3 and opposite it in wall 10, a like opening 11. In side wall 4—which is normal to wall 2, there is a like opening 5, and in the rearmost wall 12 there is an opening 13. As can be seen in FIG. 1, openings 3, 11 and 5, 13 are at different levels. In the top wall 6 extends a slot 7 which merges with opening 5 in wall 4 and opening 13 in wall 12 and in the bottom wall 8 there is a like slot 9 which merges with opening 3 in wall 2 and opening 11 in wall 10.

Figure 3:
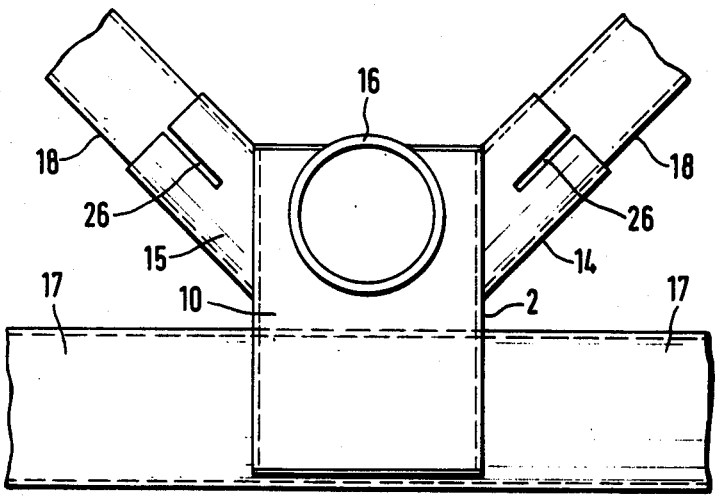

From oppositely disposed walls 2 and 10 there extend—angularly relative to the walls—spigots 14 from wall 2 and spigots 15 from wall 10. In FIG. 3, the spigots 14, 15 are slitted at 26 for part of their length.

Figure 2:
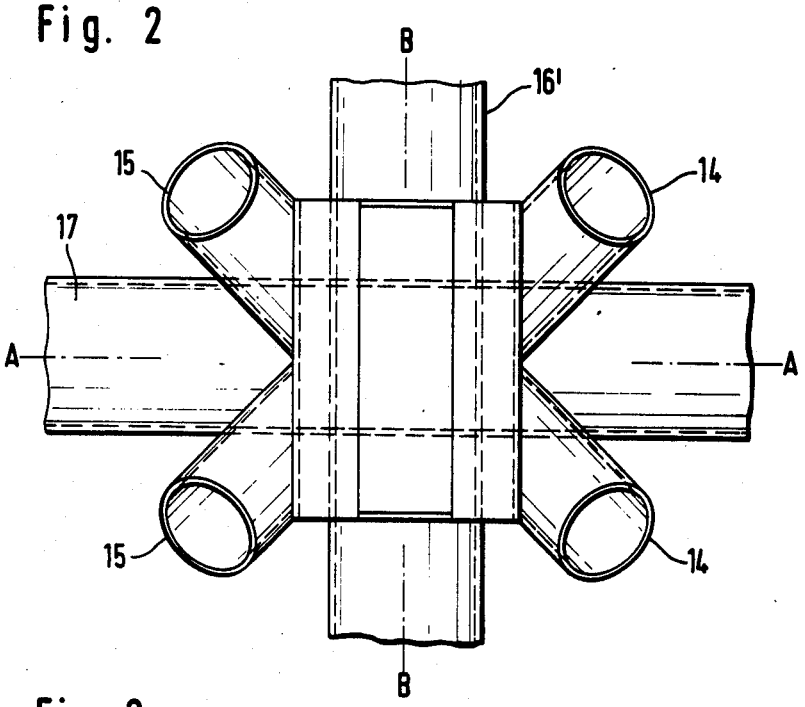
Figure 4:
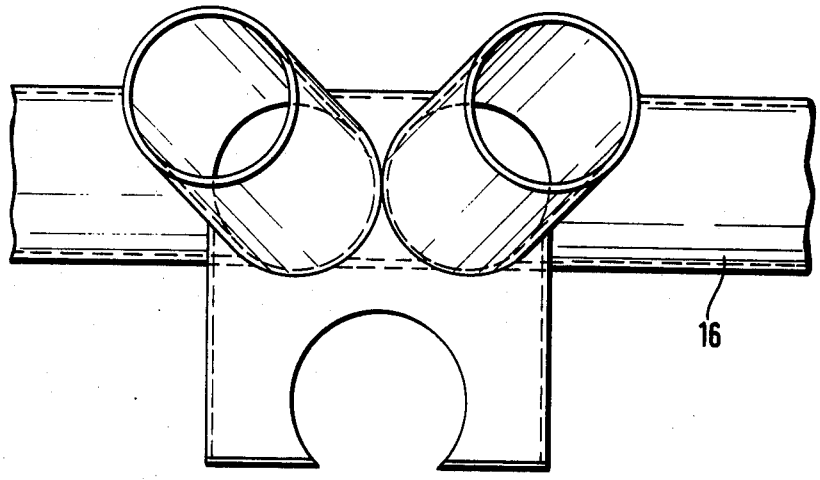
Figure 5:
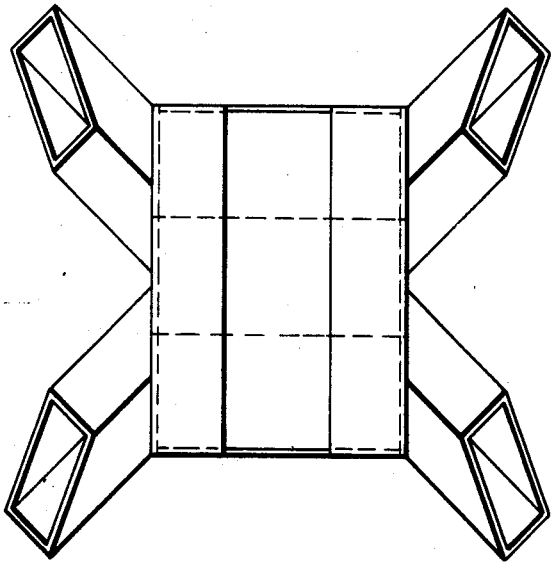

FIGS. 3–5 illustrate the use of the new joint. It can easily be seen that through openings 5 and 13 a tubular structural element can be passed. It is shown in FIGS. 2 and 3 and indicated by the numeral 16. In the same way a tubular member 17 is passed through openings 3, 11. Thus members 16 and 17 extend at different levels and cross one another.

Into spigots 14 and 15 tubular elements 18 are inserted.

In practice elements 16 and 17 may be tie beams and tubular elements 18 may be rafters. But these tubular, structural elements may—in constructions which are not roof structures—fulfill different tasks.

Figure 6:
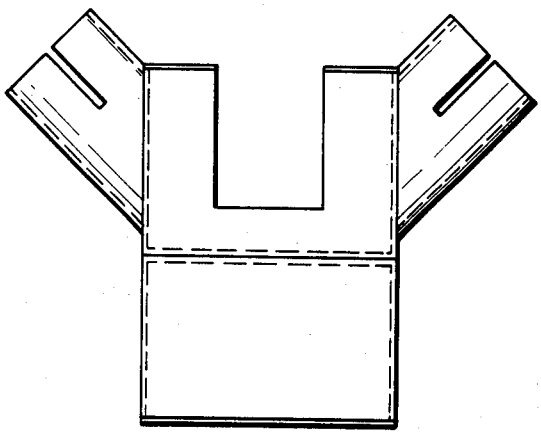
Figure 7:
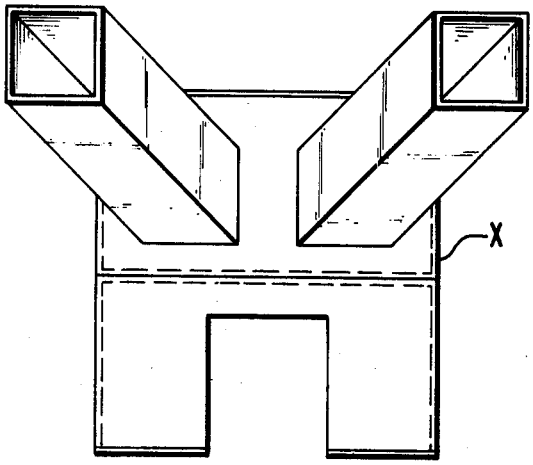

The joints shown in FIGS. 5, 6, 7 have been designed to serve as connecting elements for tubular structural elements of rectangular cross section. Apart from that they are in every respect identical with the joints of FIGS. 1–4 which are designed to connect structural elements of circular cross section.

Figure 8:
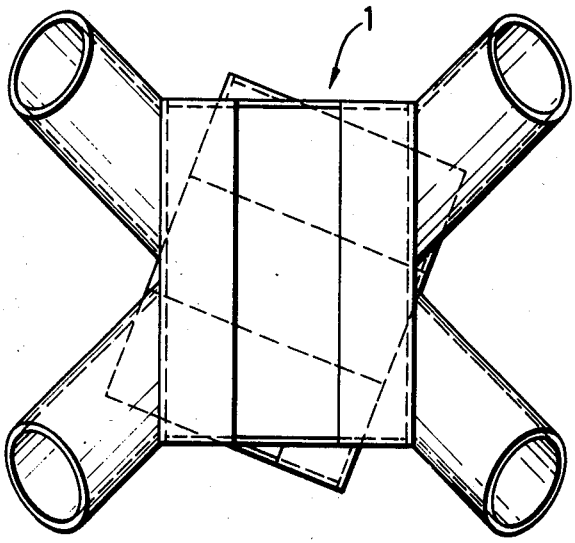
Figure 9:
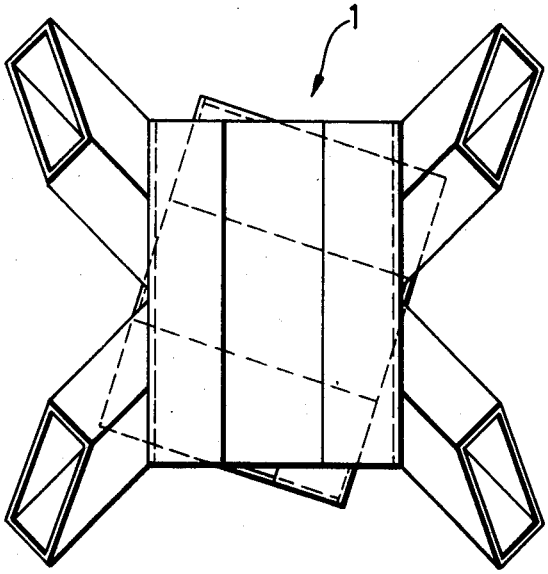

In some cases the new joint should permit adjustment for placing and orientating the structural elements to be connected. Such a contingency may be met by the examples shown in FIGS. 8 and 9. Here the body 1 is composed of two parts which are divided from one another on a plane X, (e.g. as seen in FIG. 7), and are turnable relative to one another. Thus the lower part could be turned (as shown in broken lines in FIGS. 8 and 9) against the upper part from which the above mentioned spigots extend.

Figure 10:
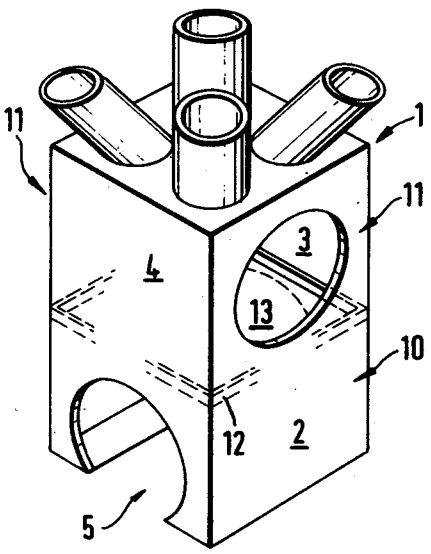
FIG. 10 is a further embodiment of the new joint.

Turning now to FIG. 10 there is provided a box like body 1 generally of the type described in detail in connection with FIG. 1 being a prismatic, hollow body designated as a whole by the numeral 1. In the side wall 2 of body 1 is provided an opening 3 and opposite it, in the opposite wall, a like opening. In side wall 4—which is normal to wall 2, there is—at a lower level—a like opening 5, and in the rearmost wall there is an opening 13.

The difference between the joint of FIG. 1 and that of FIG. 10 resides therein that the new joint is composed of two parts: the lower one indicated by the numeral 10 and an upper one indicated by the numeral 11. The two parts are joined together—as will be seen later—along a line or plane 12. The use of this two part joint makes it possible to connect, by means of it, very large bars or pipes which due to their length and in view of limits imposed by local conditions cannot be inserted into the opening of the joint in axial direction of the bar or pipe.

Figure 11:
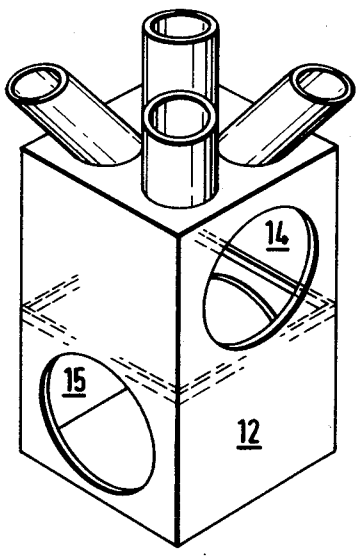
FIG. 11 shows a similar, but slightly different embodiment.

FIG. 11 shows a like joint in which the openings at different levels are provided, the opening 15 at the lower level does not merge into a slot as is the case with the joint of FIG. 1. This embodiment does not require further description. It is also composed of two parts joined together at line 12.

Figure 12:
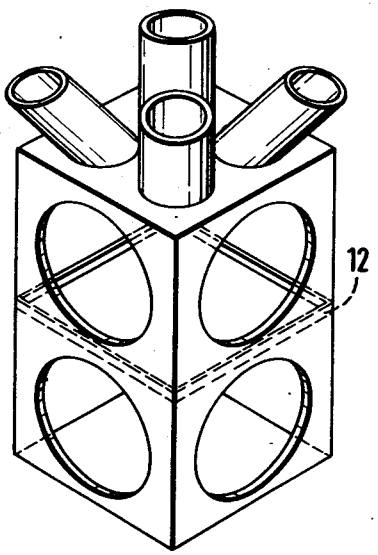
FIG. 12 is yet another variant of the joint.

The embodiment shown in FIG. 12 has two superposed openings in every one of its four side walls (only two of which are seen in the drawing). Also here the joint is composed of two parts joined together along line 12.

Figure 13:
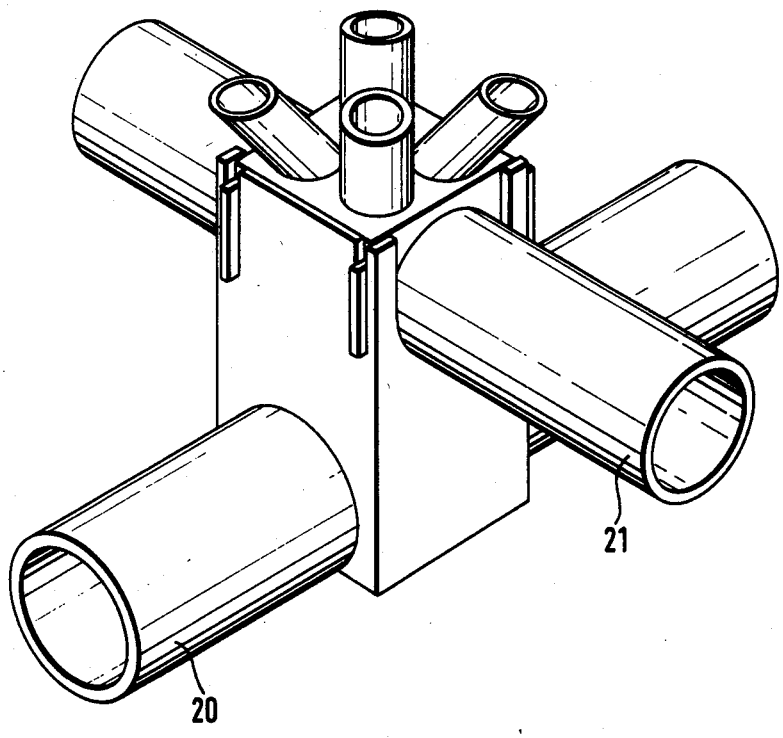
FIG. 13 illustrates the use of the embodiment of FIG. 10.

FIG. 13 shows the embodiment of FIG. 11 in use. It interconnects a pipe element 20 with another, like pipe element 21. Elements 20 and 21 extend at different levels, across one another.

Figure 14:
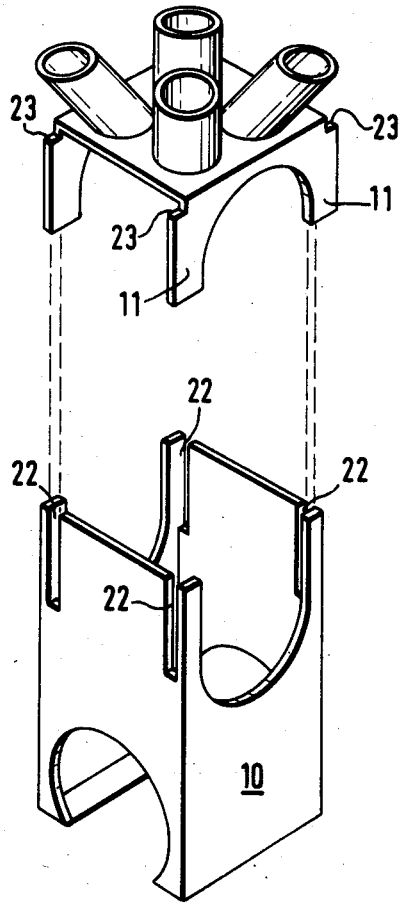
FIG. 14 is an exploded view of the embodiment of FIG. 10.

FIG. 14 shows the two parts 10 and 11 of the embodiment of FIG. 10. As can be seen there are provided in the lower part 10 four vertical slits 22. At the upper part 11—at two opposite side walls of part 11—there are provided vertical ribs 23. Part 11 fits on part 10 with ribs 23 sliding into slits 22. In this manner the two parts can be accurately orientated for connection with one another. (The final connection being referred to later).

In all embodiments described and shown in FIGS. 10–14 spigot like sleeves extend from the top of the respective element. These sleeves are positioned in angular relationship to one another as described in connection with FIGS. 1–9.

Figure 15:
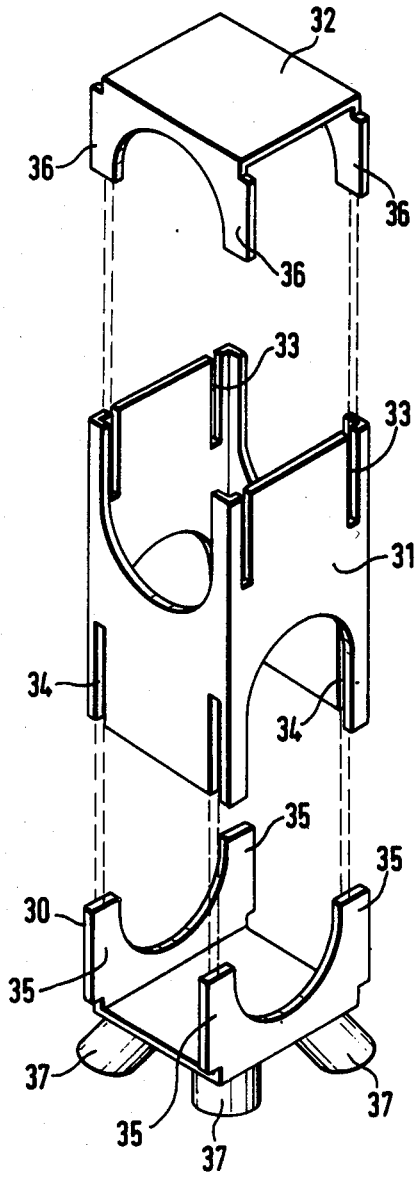
FIG. 15 is a like view of a different embodiment.

Turning now to FIG. 15 there is shown a joint composed of a lowermost part 30, a central part 31 and a top part 32. These parts can be joined together to form a connecting joint of four sided prism shape. Here again are provided slits 33 extending from the upper edges of part 31 downwardly and slits 34 extending from the lower edges of part 31 upwardly.

At the lowermost part 30—in the way already described—there are provided vertical ribs 35 which fit into the lower slits 34 of part 31.

Like ribs 36 are provided at part 32 which fit into slits 33 of part 31.

It will be understood that parts 30, 31, 32 combine to form a joint which has spigot like sleeves 37 extending from its bottom. It goes without saying that the assembled joint can be used also with the sleeves 37 extending upwardly, i.e. the assembled connector being turned upside down as against the position of FIG. 15.

Figure 16:
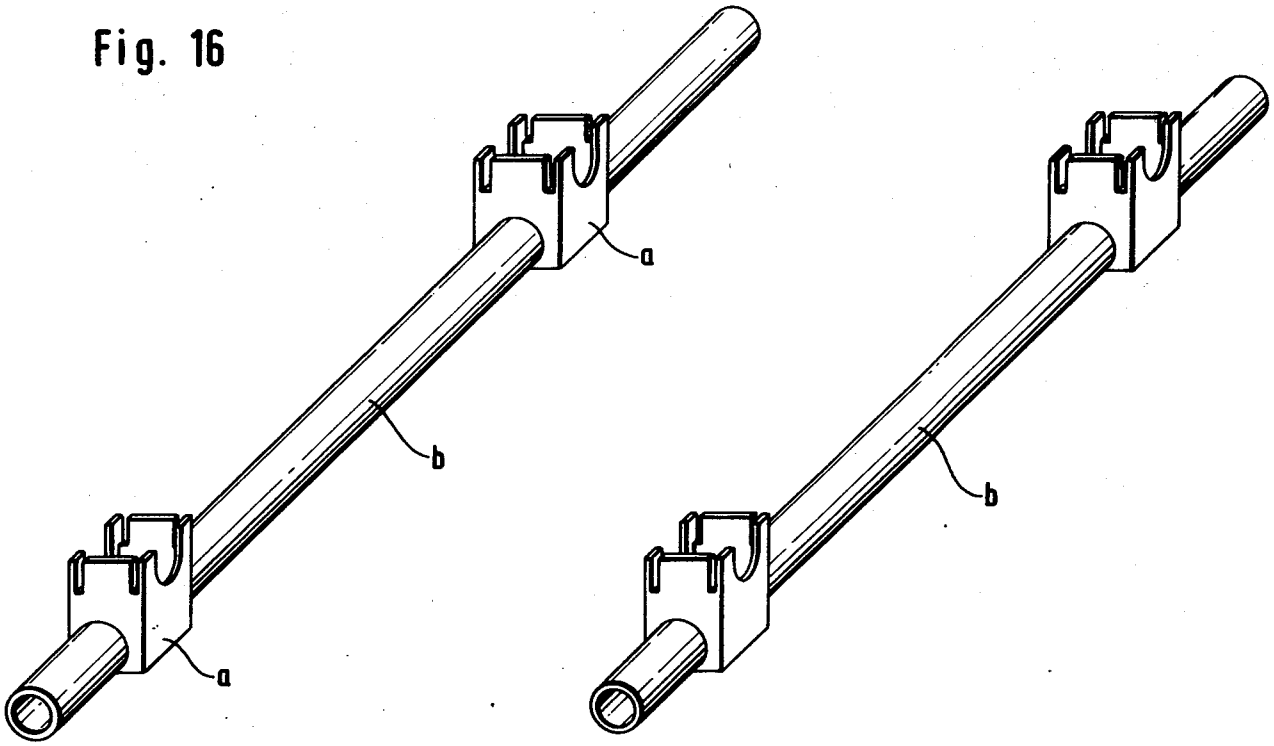
FIGS. 16–17–18 illustrate the steps of the operation of assembling a structure from joints of the embodiment of FIG. 10 and pipe members.
Figure 17:
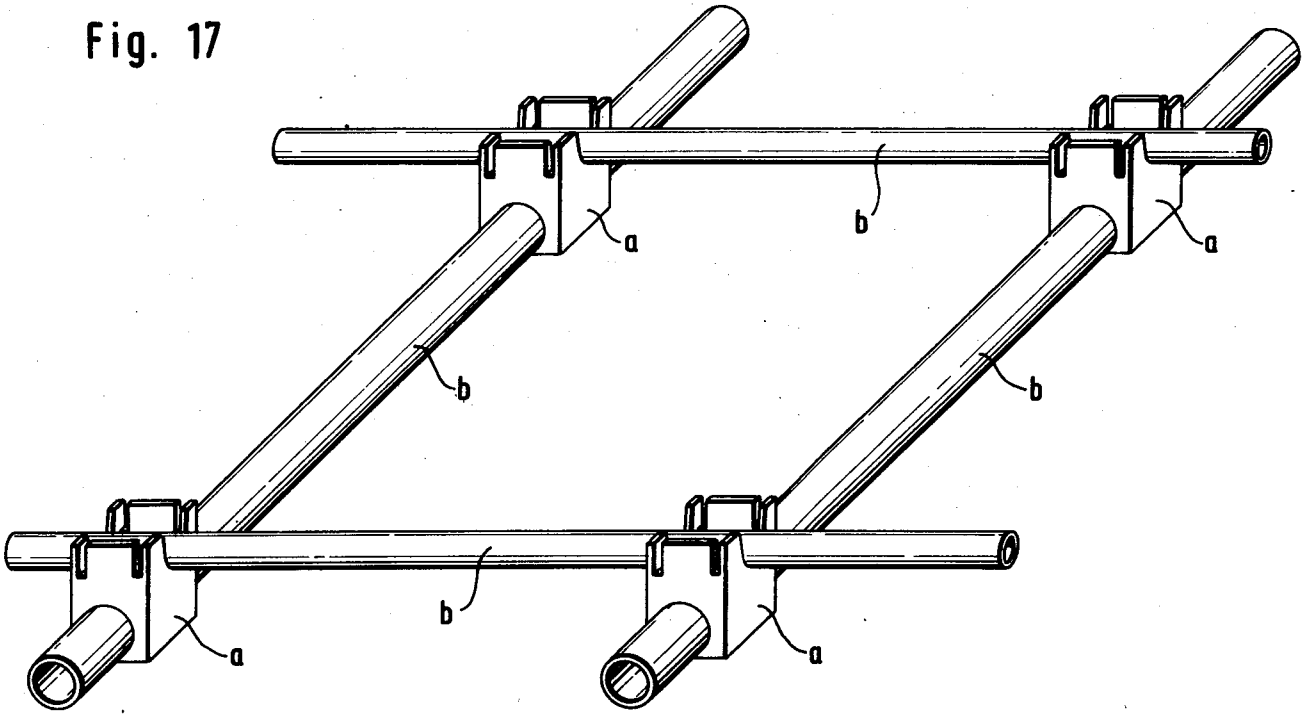
Figure 18:
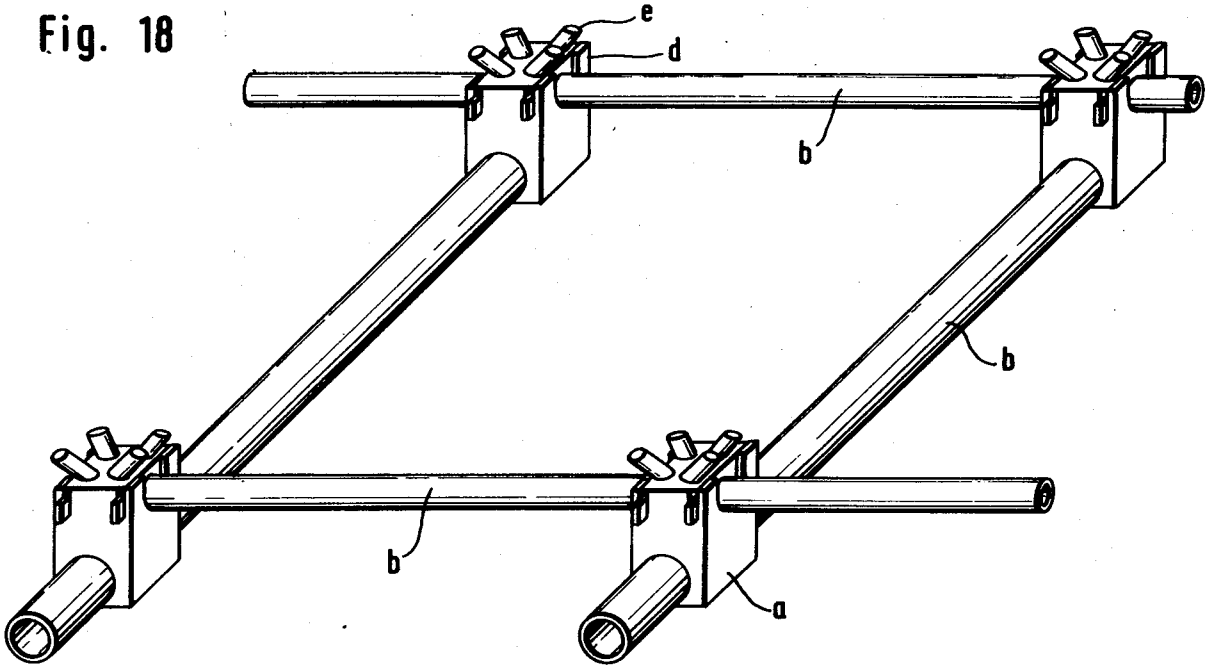

The use of the new connecting joint will become clear from FIGS. 16–18. Here is shown, by way of example four lower parts a of the embodiment of FIG. 14, placed at four corners of a square. In a second step long pipes b are inserted into the openings of a pair of parts a, so interconnecting two parts a with pipes b parallel to one another. Now—see FIG. 17—two further pipes are placed into the open two sides of parts a. Finally the upper parts d of the composite joints are placed on the lower parts a with sleeves e extending upwardly. (see FIG. 18). Accuracy is ensured by the ribs on one part engaging in the slits of a second part. The two (or three) parts of a joint are then welded to one another.

Figure 19:
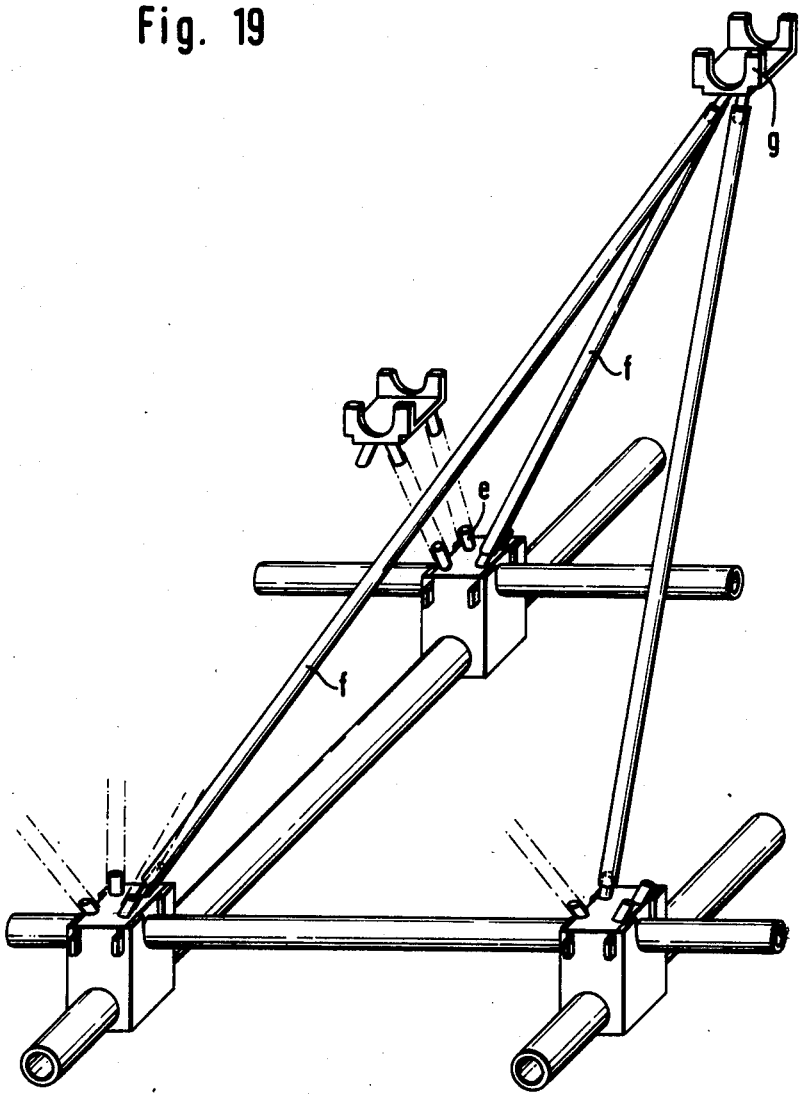
FIG. 19 illustrates a further step in the assembling operation.

Such an assembly can now form part of the structure shown in FIG. 19 where from sleeves e bars f extend upwardly to connector parts g with downwardly extending sleeves which receive the upper ends of bars f.

In some cases it might be preferable to use spigot like members extending from the cylindrical or prismatic hollow body which are not circular, it having been found that while spigot like sleeves of circular cross sections are well adapted for connecting pipes or bars of circular cross section which are either slid into or onto the said spigot like sleeves, it would be within the scope of the invention to have spigots of different shape extend from the cylindrical or prismatic body. Thus, the said spigot like members may be sleeves of square or other geometrical cross section—for use with bars or pipes of like cross section, or they may be short flattened arms extending from the said cylindrical or prismatic body. Such arms are mainly—but not exclusively—intended to serve in the connection of pipe members in forming spatial structures. In that case—in one practical embodiment—circular pipes are used the ends of which (at which they are to be connected) are flattened whereupon this end can be slid on or laid on said flat, spigot like short arms and screw bolts are screwed across the said ends, such as to firmly connect the respective pipe to the joint.

Figure 20:
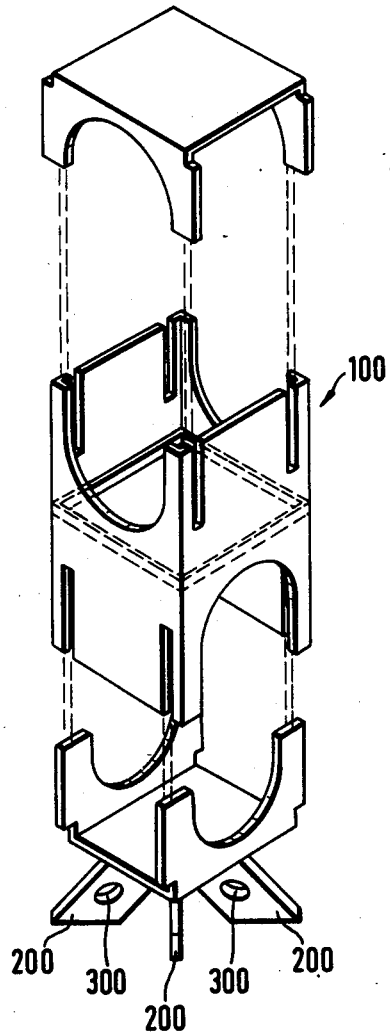
Figure 21:
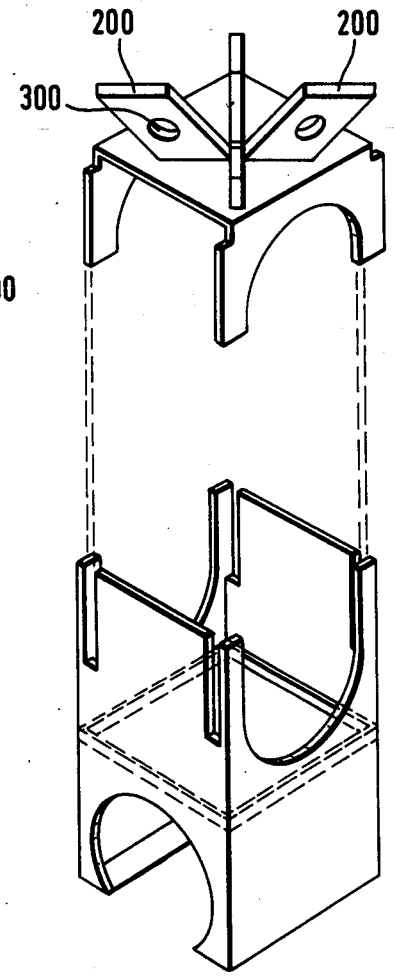

This variant of the invention is shown in FIGS. 20, 21.

FIG. 20 shows a joint according to the invention i.e. being composed of three parts.

The connecting joint shown in FIG. 20 is indicated as a whole by the numeral 100. From the bottom of its lowermost part extend four flat, plate shaped arms 200 onto which can be slipped the flattened end of a circular pipe.

According to FIG. 21 which is self explanatory, the joint consists of two parts and arms 200 extend from the top of the uppermost part.

Figure 22:
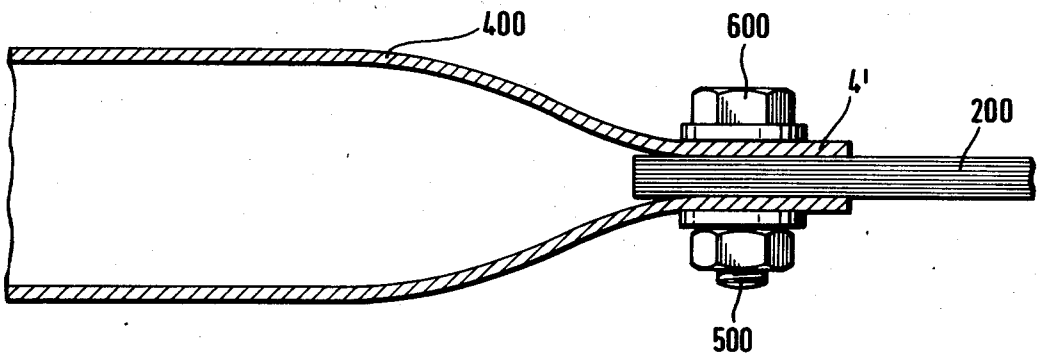
FIGS. 22, 23 show details and illustrates the use of the variants of FIGS. 20, 21.

According to FIGS. 20 and 21 the arms 200 are provided with one (or more) throughgoing holes 300. A like hole is provided in the flattened end 4' of a pipe 400, (FIGS. 22, 23).

After slipping the flattened end 4' of the pipe onto the arm 200 and bringing the holes into register a screw bolt 500 is passed across the so united members 200 and 400 and is secured by a nut 600 and counter nut.

Figure 23:
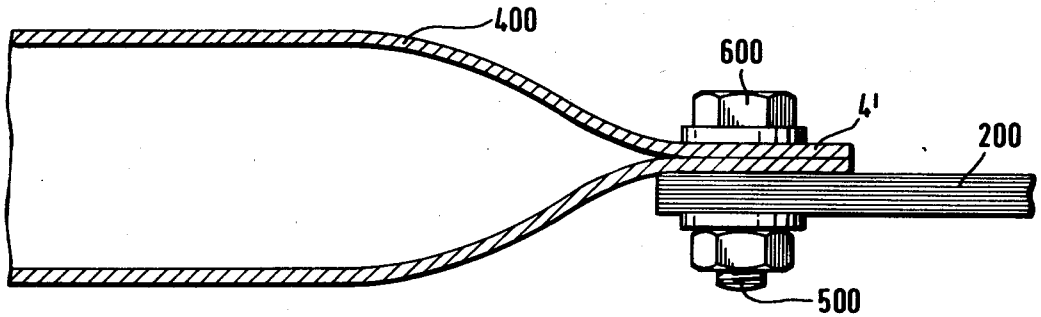

Alternatively, according to FIG. 23, the flattened end 4' of pipe 400 is fully closed and the end is laid against an arm 200 at the outside thereof and secured by a throughgoing screw bolt 500 and nut 600 as already described.

Obviously there may be more than one such screw connection between the pipe end and the short arm.

What is claimed is:

1. A structural element connecting joint comprising a hollow multi-sided part with at least two pairs of opposite sides with the sides in each said pair arranged in spaced parallel relation and with said sides in each said pair extending transversely of the sides of the other said pair, each of said sides having an elongated direction, each of said pair of sides having axially aligned openings through each side of said pair with the axis of the openings in one said pair of sides extending transversely of the axis of the other said pair of sides and said axes being spaced apart in the elongated direction of said sides, said aligned openings arranged to receive elongated structural elements extending therethrough with the structural elements disposed transversely of one another, and a number of axially extending spigot-like sleeves secured to and projecting outwardly from at least one of said sides of said part with the axes of each of said sleeves extending obliquely outwardly from the side to which said sleeve is secured, the point of securement of each of said sleeves to said sides being spaced from said openings and the axes of said sleeves extending angularly relative to the axes of said openings.

2. A structural element connecting joint, as set forth in claim 1, wherein said multi-sided part is a six-sided prism having three pairs of opposite sides with said sides of each said pair extending normally of the other said sides.

3. A structural element connecting joint, as set forth in claim 2, wherein said openings are located in two said pairs of opposite sides and said third pair of opposite sides have axially extending slots therein each in communication with the space within said part axially aligned with the openings through one said pair of sides.

4. A structural element connecting joint, as set forth in claim 1 or 3, wherein said spigot-like sleeves are slit in the axial direction thereof.

5. A structural element connecting joint, as set forth in claim 1, wherein said multi-sided part is formed of a number of subparts divided transversely of the elongated direction of said sides with each of said subparts including at least two said pairs of opposite sides.

6. A structural element connecting joint, as set forth in claim 5, wherein one of said subparts is provided with slits extending in the elongated direction, and another said subpart is provided with ribs extending in the elongated direction so that said ribs can be slidably fitted into said slits for interengagement of said subparts.

7. A structural element connecting joint, as set forth in claim 5, wherein two of said subparts have an additional side extending transversely of said at least two pairs of opposite sides and forming a closure across one of the transverse ends of said two pairs of opposite sides.

8. A structural element connecting joint, as set forth in claim 5, wherein said part comprises a first end subpart, a second end subpart spaced from said first end subpart and a central subpart extending between said first and second end subparts.

9. A structural element connecting joint, as set forth in claim 1 or 5, wherein arms of polygonal cross-section extend outwardly from at least one of said sides of said multi-sided part.

10. A structural element connecting joint, as set forth in claim 9, wherein said arms are flat plate shaped members.

11. A structural element connecting joint, as set forth in claim 9, including an axially extending tubular element flattened at the opposite ends thereof with at least one of said flattened ends arranged to be fitted over one of said arms.

12. A structural element connecting joint, as set forth in claim 9, wherein an axially elongated tubular structural element has flattened ends, at least one of said flattened ends is provided with an opening therethrough, one of said arms having an opening therethrough, the opening in said tubular structural element being alignable with the opening in said arm and a screw bolt arranged to extend through said openings and to secure said structural element to said arm.

* * * * *